United States Patent [19]

Crick

[11] Patent Number: 4,780,009

[45] Date of Patent: Oct. 25, 1988

[54] STEAM GENERATOR TUBE SHEET AUTOMATIC STAMPING DEVICE

[75] Inventor: David L. Crick, Chattanooga, Tenn.

[73] Assignee: Combustion Engineering, Inc., Windsor, Conn.

[21] Appl. No.: 42,732

[22] Filed: Apr. 27, 1987

[51] Int. Cl.[4] ..... B41J 3/02; B41F 17/00

[52] U.S. Cl. ..... 400/118; 400/127; 101/4

[58] Field of Search ..... 400/118, 121, 127, 128, 400/130; 101/4, 35

[56] References Cited

U.S. PATENT DOCUMENTS

| | | | |
|---|---|---|---|
| 3,606,162 | 9/1971 | Lehmann | 101/35 X |
| 3,867,882 | 2/1975 | Ahlgren et al. | 101/35 |
| 3,960,072 | 6/1976 | Ahlgren et al. | 101/35 |
| 4,089,262 | 5/1978 | Sopora | 101/4 |
| 4,410,287 | 10/1983 | Speicher | 400/134 |
| 4,557,191 | 12/1985 | Speicher | 400/121 X |
| 4,591,279 | 5/1986 | Speicher | 400/121 |
| 4,665,600 | 5/1987 | Faurie et al. | 101/35 |

FOREIGN PATENT DOCUMENTS 2460134 7/1975 Fed. Rep. of Germany ..... 101/4

OTHER PUBLICATIONS

Sales Brochure for Dot-A-Mark, Model 3200 (undated, one page).

Sales Brochure for Dot-A-Mark, Model 2000 (undated, one page).

*Primary Examiner*—Clifford D. Crowder

*Attorney, Agent, or Firm*—Chilton, Alix & Van Kirk

[57] ABSTRACT

A stamping device (28) having a stationary base assembly (76), a carriage assembly (52) mounted on the base assembly for stepwise horizontal movement in a first direction relative to the base assembly, and a marker assembly (34) mounted on the carriage assembly for stepwise horizontal movement in a second, perpendicular direction. The marker assembly includes a marking pin (30) vertically actuable by an air cylinder (42) for impacting the tube sheet (14) adjacent a preselected tube (16). A control system (124) sequentially activates stepping motors (60,66) and the air cylinder to produce a dot matrix character (114) on the tube sheet.

13 Claims, 5 Drawing Sheets

STEAM GENERATOR TUBE SHEET AUTOMATIC STAMPING DEVICE

BACKGROUND OF THE INVENTION

The present invention relates to the servicing of heat exchangers and, more particularly, to a device for engraving or stamping identification characters at each tube location in the tube sheet of a steam generator.

In many respects, nuclear steam generators are similar to other large heat exchangers, in that a multiplicity of tubes are connected to a tube sheet in a head region of a large pressure vessel. Periodically, different maintenance procedures must be performed on at least some of the tubes. The unique characteristic of nuclear steam generators is that tube maintenance or repair procedures must be performed in a highly radioactive environment, which necessitates the use of remotely controlled servicing equipment.

The nuclear industry has developed an extensive array of specialized equipment for cleaning, inspecting, plugging, sleeving, repairing and otherwise servicing individual steam generator tubes during outages. However, since most nuclear steam generators include anywhere between 5,000 to 10,000 tubes, the identification of particular tubes for performing the servicing procedures has posed considerable difficulties to maintenance personnel. A related problem has been the difficulty of verifying that the intended tube was in fact tested or serviced in a way that satisfies the records requirements associated with quality assurance regulations.

Conventionally, the identification and verification of individual tubes has been accomplished by a combination of human and electronic vision, i.e., direct observation for short time intervals to avoid human exposure to excessive radiation, coupled with television or other optical devices.

This has proven unreliable and thus the need exists for an improved technique for the identification of the tubes at the tube sheet.

SUMMARY OF THE INVENTION

This problem is solved in accordance with the present invention by a remotely operable device for marking each tube location on the tube sheet by a stamp, or engraving, that can be viewed remotely by a video camera or the like. The invention is in the form of a device having a base assembly, a carriage assembly and a marking assembly which are relatively perpendicularly moveable in the horizontal plane, and which carry a marking pin that is vertically actuated to impact the tube sheet and thereby form a permanent "dot". The horizontal movements and the vertical impacting are controlled discretely such that each character is formed on a dot matrix having, for example, six cells.

Preferably, the device occupies an envelop smaller than about one cubic foot, and weighs less than about fifty pounds, so that it can be positioned adjacent the tube sheet by a robot of the type conventionally used in the servicing of nuclear steam generators. Preferably, the device carries a locking pin assembly which includes fingers for engaging at least one tube in the tube sheet, thereby further stabilizing the device during the marking of other tube locations.

A high degree of precision movement of the marking pin is achieved by the use of stepping motors and rack and spur gear arrangements for producing stepwise horizontal movement of the pin during the formation of each character.

BRIEF DESCRIPTION OF THE DRAWINGS

The preferred embodiment of the invention will be described below with reference to the accompanying drawings, in which.

DESCRIPTION OF THE PREFERRED EMBODIMENT

Figure 1:
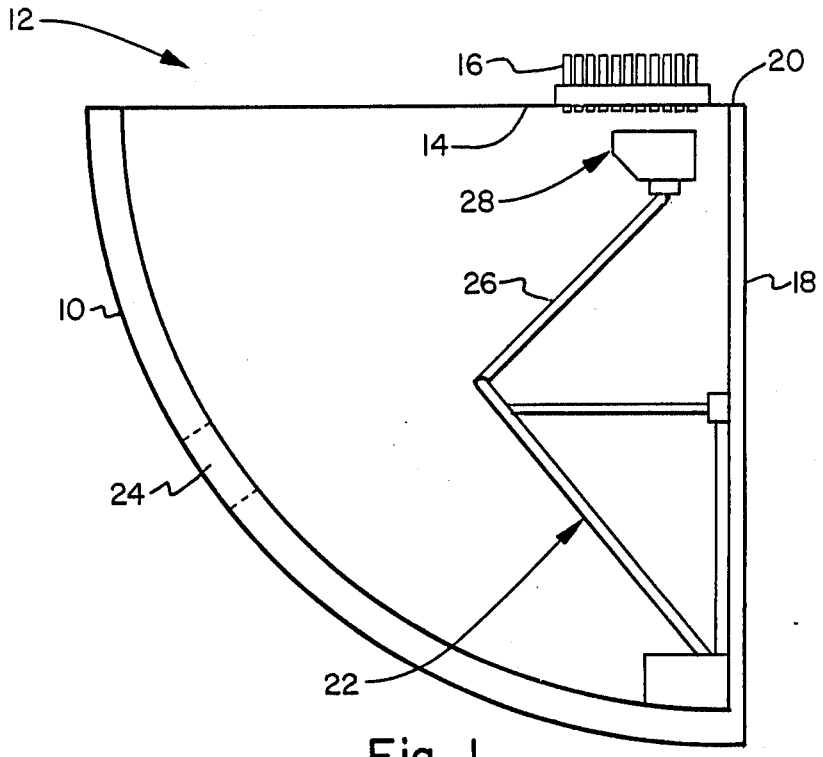
FIG. 1 is a schematic view, partly in section, of a quadrant of the lower head of a nuclear steam generator, with the invention deployed on a robot arm.

FIG. 1 shows the lower head 10 of a nuclear steam generator 12, having a horizontal tube sheet 14 which supports a multiplicity of vertically oriented tubes 16. Typically, a column 18 extends from the bottom of the vessel to the center of the tube sheet 14, and a divider plate 20 separates the tubes in one half of the generator from the tubes in the other half of the generator. Conventional servicing techniques for the tubes include the insertion of a robot 22 or the like through the manway 24 and temporary attachment thereof to the column 18 or other structure. The robot arm 26 may be then articulated within the head area whereby a tool or the like can be deployed near substantially any individual tube 16.

In accordance with the present invention, a stamping or marking device 28 suitable for deployment by the robot arm 26, is provided. Such device, when used in known nuclear steam generators, should be small enough to pass through the manway 24 (e.g., less than about one cubic foot envelope volume) and be within the load weight limit of the robot arm 26 (e.g., about 50 pounds). Preferably, the outer dimensions of the device are about six inches per side, with a total weight of only about 20 pounds. In a typical nuclear power plant having four steam generators, each having nearly 10,000 tube ends, a total of nearly 40,000 tubes must be individually identified. Thus, the device of the present invention is adapted to stamp a five or six character identification mark on the tube sheet adjacent to each individual tube end. In a steam generator having tubes 16 with up to 0.875 inch outside diameter located on a square or triangular pitch of less than 1.375 inches, and the tube ends extending 0.22 inch past the face of the tube sheet 14, the device 28 in accordance with the invention can stamp a six character identification mark for substantially every tube.

Figures 2A, 2B:
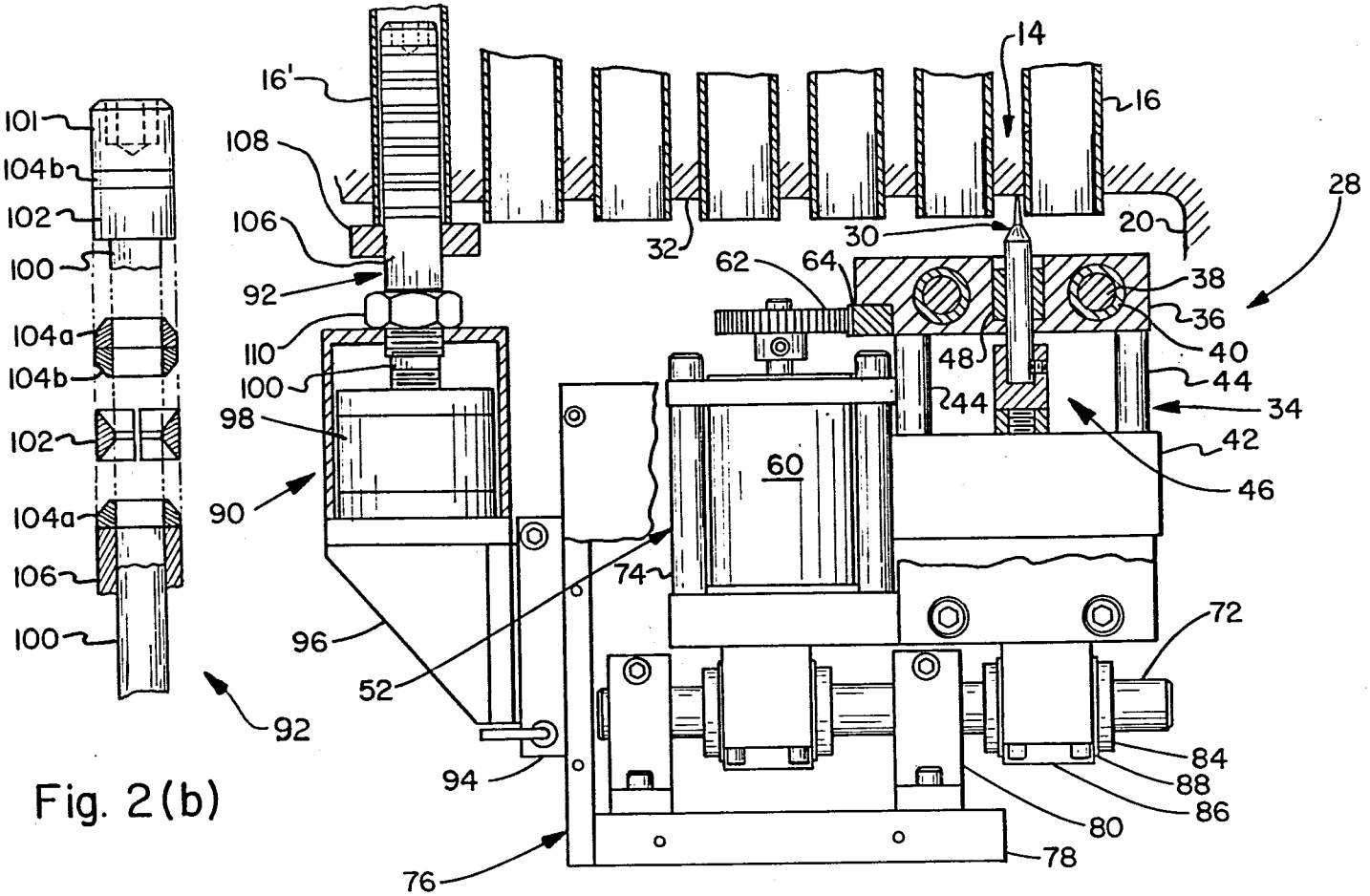
FIG. 2(*a*) is a side view of the marking device, in the orientation shown in FIG. 1, during the marking of the tube sheet, and FIG. 2(*b*) is an exploded view of the locking pin portion of the device.
Figure 4:
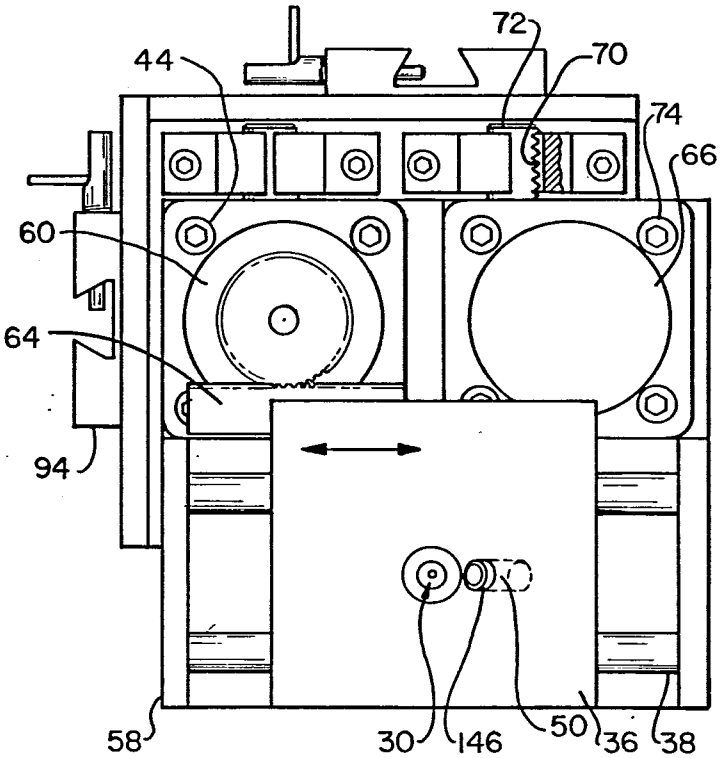
FIG. 4 is a top view of the marking device.
Figure 3:
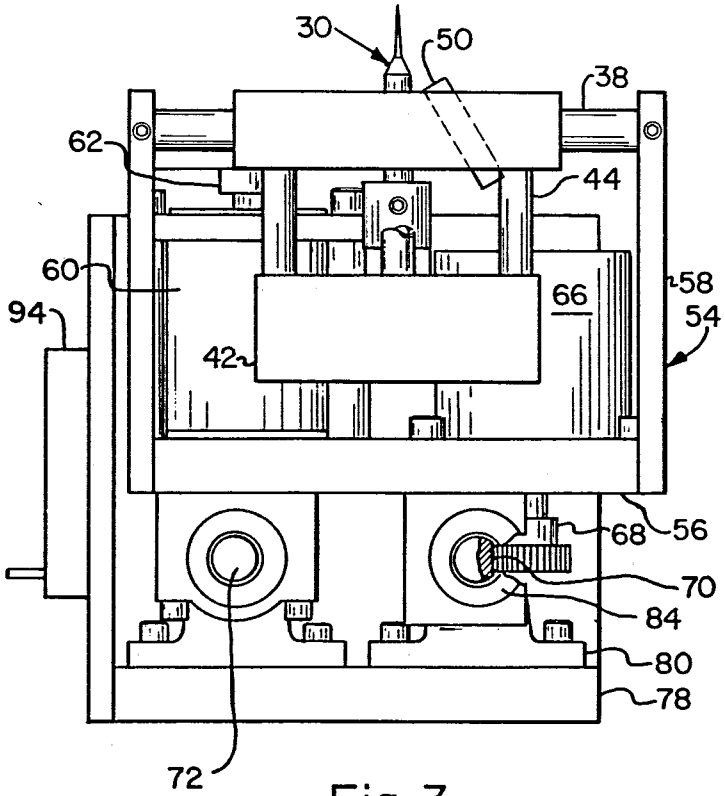
FIG. 3 is a front view of the marking device, as seen from the right in FIG. 2.
Figure 2A:
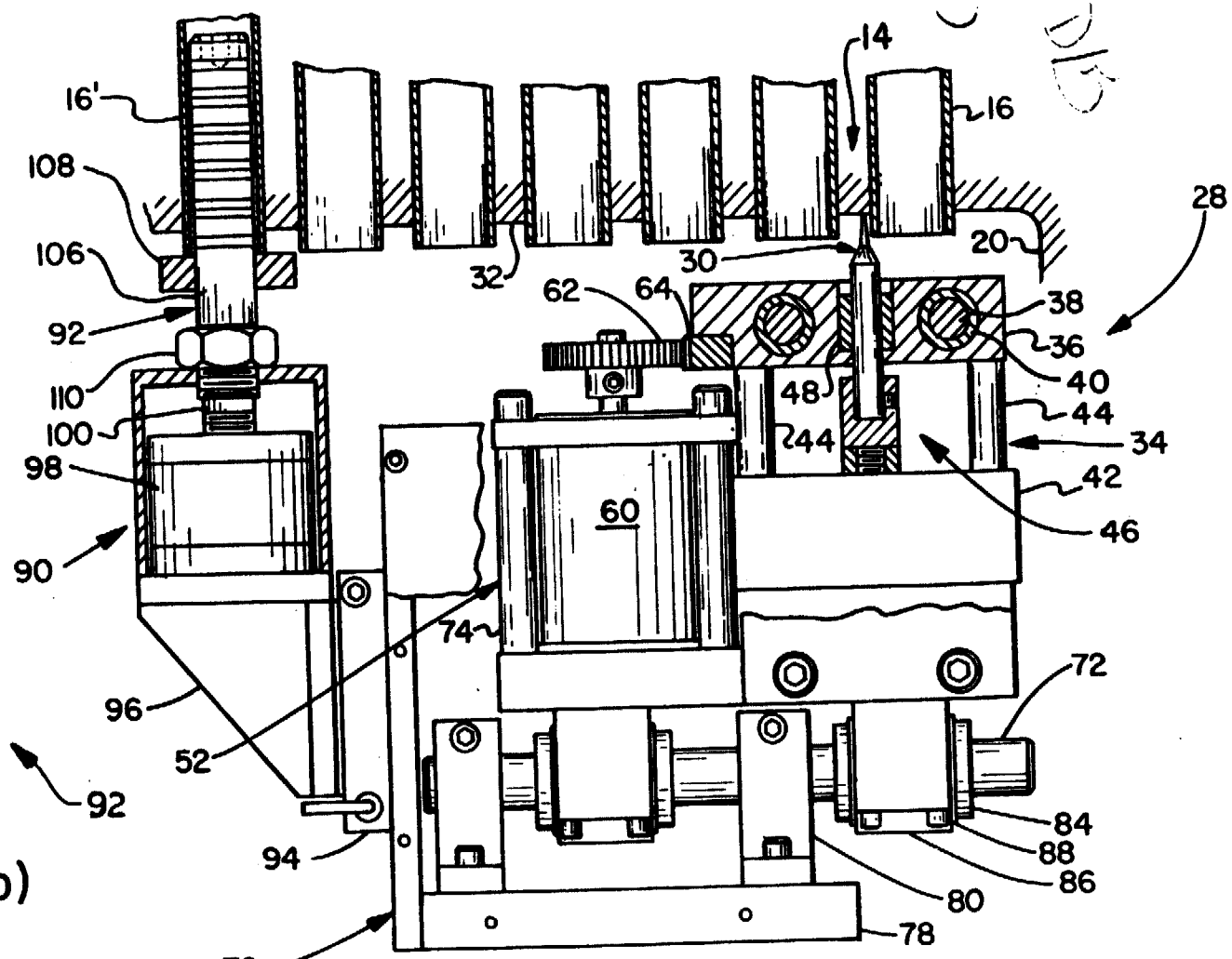
Figure 2B:
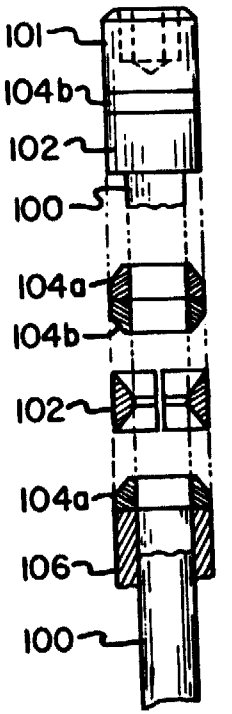

FIGS. 2, 3 and 4 show the marking device 28 in accordance with the invention. A marking pin 30 is shown in contact with a tube sheet ligament 32 (the portion of the tube sheet between adjacent tubes), during the stamping of an identifying character. The device includes three, and preferably four, interrelated assemblies, which are sequentially operated by a control system to be described below in connection with FIG. 6.

The marking assembly 34 includes the marking pin 30 which is mounted for vertical reciprocal motion in a pin guide 36, preferably in the form of a relatively thick plate or the like. One or more shafts 38 traverse the pin guide 36 horizontally and are coupled thereto by bushings 40, preferably Thompson ball bushings, whereby the pin guide 36 is horizontally movable relative to the shafts 38. For convenience, the movement of the pin guide 36 into and out of the plane of FIG. 2, will be referred to as "Y axis" movement. The marking assembly 34 also includes an air cylinder 42 such as a Bimba flat type cylinder having a bore and stroke sufficient to exertan impacting force of about 140 pounds at 80 p.s.i., for actuating the marking pin 30 vertically into contact with the tube sheet 14. The air cylinder 42 is preferably secured to the pin guide 36 by, for example, four mounts 44 which threadably or otherwise maintain a tight, rigid relationship between the air cylinder 42 and the pin guide 36. The marking pin 30 is, in effect, part of a piston arrangement 46 actuated by the air cylinder 42, whereby the marking pin 30 is reciprocated through the ball bushing 48.

Preferably, the marking assembly 34 includes a sleeve 50 or the like in the pin guide 36, for locating an optical device such as a camera or flexible optical fiber scope, for providing input to the operator as to the relationship of the pin with the tube sheet. An optical encoder or similar device is physically affixed to the pin guide 36, to generate an electronic signal to the motion control system (to be described below with reference to FIGS. 5 and 6), for providing the relative location of the marking pin within the desired character matrix.

The carriage assembly 52, as more fully explained below, is adapted for horizontal movement perpendicularly to the movement of the marking assembly 34 (i.e., the carriage assembly moves along the "X axis"). The carriage assembly 52 preferably has a "U" shaped frame 54 including a horizontal bottom plate 56 and two vertical opposed side plates 58. The shafts 38 which support the marking assembly 34 are part of the carriage assembly 5 and are rigidly supported at their ends by the side plates 58. A vertically upwardly oriented stepping motor 60 is mounted on bottom plate 56 of the carriage assembly 52, so that a spur gear 62 engages a rack 64 on the inner edge of the pin guide 36. In this manner, rotation of the spur gear 62 produces the Y-axis movement of the marking assembly 34 relative to the carriage assembly 52. A downwardly oriented stepping motor 66 is mounted on the carriage assembly adjacent the upwardly oriented stepping motor 60, for the purpose of producing movement of the carriage assembly 52 along the "X axis". The stepping motor 66 rotates a spur gear 68 that extends below the bottom plate 56 of the carriage assembly and engages a cylindrical rack 70 connected to one of a pair of shafts 72. The stepping motors are secured to the carriage assembly by motor mounts 74 similar to the cylinder mounts 44 on the marking assembly.

A base assembly 76 supports the weight of the marking assembly 34 and the carriage assembly 52, and is adapted for supportive engagement with the robot arm 26 (FIG. 1) or similar support surface below the tube sheet. The base assembly 76 remains stationary during the horizontal and vertical movement of the marking pin 30. The base assembly 76 includes a base plate 78 and at least one rigidly connected shaft support member 80. The device 28 is operated so that the carriage assembly 52 is movable along the X axis relative to the base assembly 76. Preferably, the shafts 72 are rigidly mounted to the shaft support member 80, and the carriage assembly 52 moves along the shafts in the X axis as a result of the interaction between the spur gear 68 connected to the stepping motor and the rack 70 connected to the shaft. Preferably, this relative motion is implemented by Thomson ball bushings 84 between the bearing bracket 86, the bearing retaining ring 88, and the shaft 72. Thus, in this embodiment, the bearing bracket 86, retaining ring 88 and ball bushing 84 are part of the base assembly 76 and movable therewith along the shaft 72.

In order to further stabilize the marking device 28, a locking pin assembly 90 is provided for engaging one or more locking fingers 92 with tubes 16, other than those adjacent the marking pin 30. One or more dovetail support brackets 94 are secured to the base assembly 76 for receiving a mounting bar 96 which in turn supports a vertically oriented air cylinder 98. A central rod 100 having an enlarged head 101 is vertically displaced by the cylinder 98, to expand or retract female split rings 102 surrounding the rod 100 within the tube 16'. The details of the actuation may be understood more easily with reference to FIG. 2(*b*). Each split ring 102 is alternated with pairs of male ferrules 104*a,b*. The stack of rings 102 and ferrules 104 is trapped between the head 101 of rod 100 and the top of sleeve 106, which extends into the tube 16'. The rings and ferrules 104 have mating internal and external tapered surfaces on at least one of their axial ends such that when the ferrules 104 are forced into the split rings 102 the rings expand. Thus, when the internal rod 100 is retracted by the air cylinder 98, the split rings 102 slide along the tapers. Their diameters are increased, causing the rings to lock into the inside diameter of the tubes. When the action is reversed, the split rings 102 collapse back to their original size. The vertical positioning of collar 108 and jam nut 110 are established prior to operation for adjusting the offset relative to the marking pin 30.

Figure 5:
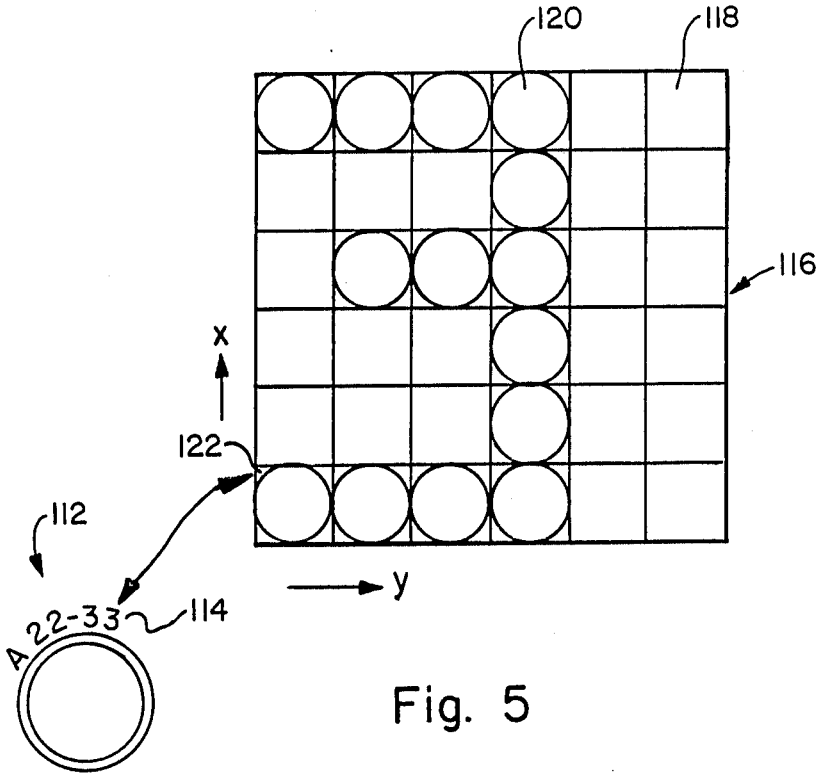
FIG. 5 is a detailed view of the characters engraved on the tube sheet at two tube locations, with an enlarged view of the matrix and dots associated with one character.

FIG. 5 illustrates a typical six character identification code 112 associated with each tube. As shown in the enlargement, each character 114 is formed on a character matrix 116, preferably a 6×6 cell array, with each cell 118 representing a possible dot 120 impression location. The character matrix 116 preferably has a home cell 122 in the lower left corner, which represents the neutral or return position of the marking pin 30. The character 114 formed by the sequential displacement and impact of the marking pin 30 along the X and Y axis directions, corresponding to the X and Y axes described above. The number of cells 118 between the home position 122 on successive character matrices, will be referred to as the character pitch.

Figure 6:
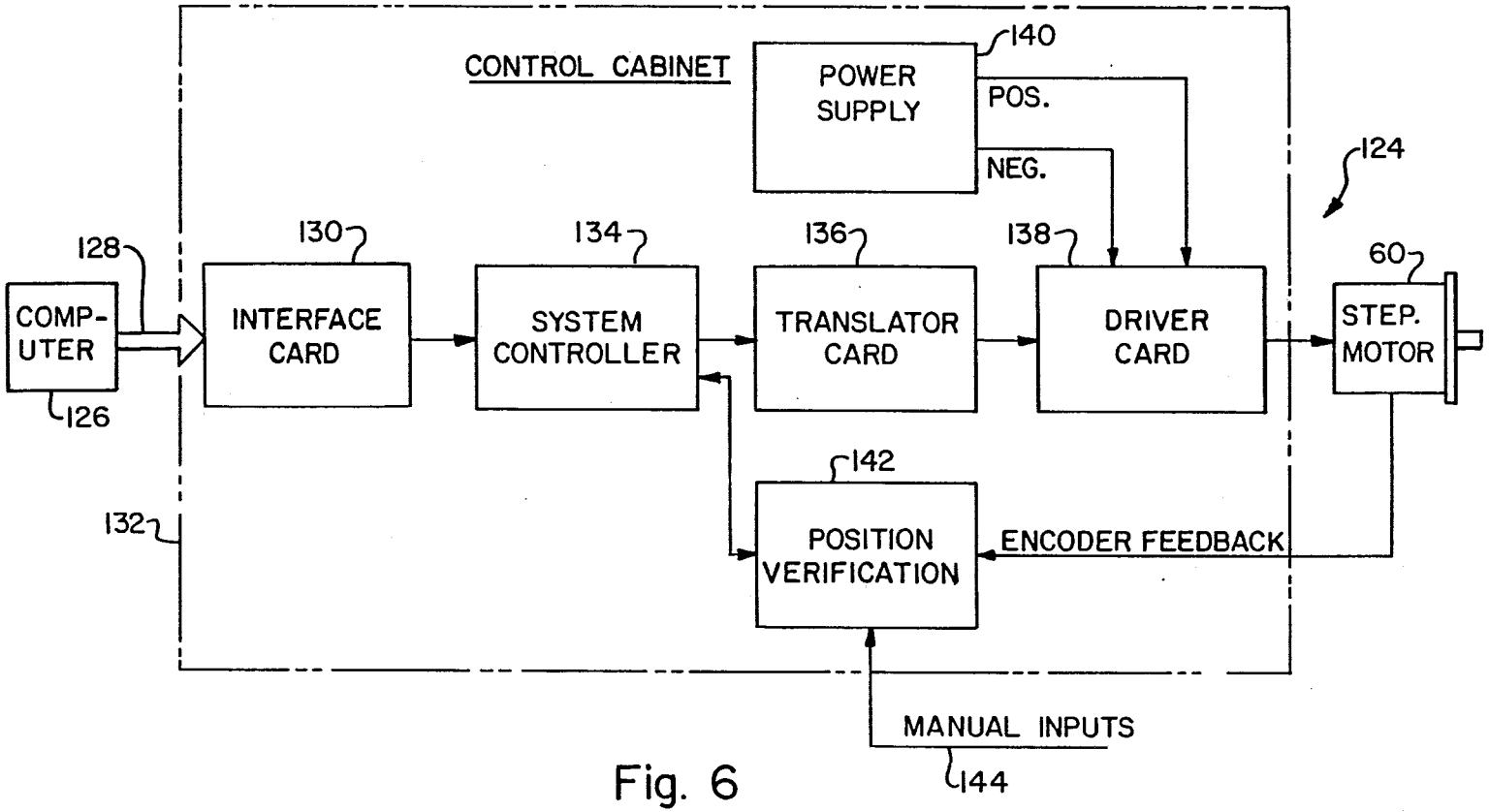
FIG. 6 is a block diagram for the control system associated with the marking device.

FIG. 6 is a block diagram representing the control system 124 for accomplishing the sequential, stepwise movement of the marking pin 30.

Commands for the stamping device are produced through the use of a microcomputer 126 such as the IBM Model XT and are transmitted via an RS232C cable 128 in the current loop mode to an interface card 130 housed in the control cabinet 132. The control cabinet 132 contains the interface card 130, a system controller card 134, translator card 136, driver module 138 for each stepping motor 60,66, a 24 volt direct current power supply 140 and a position verification card 142 with a manual input station 144 for manual positioning of the marking pin. Preprogrammed software in the computer 126 controls the sequence of events required for operation of the marking device 28. The sequence of commands are as follows:

1. Position Verification
2. Proceed
3. Command "X" movement
4. Verify "X" movement
5. Command "Y" movement
6. Verify "Y" movement
7. Engage air solenoid valve
8. Disengage air solenoid valve
9. Return to step 3 and continue The above commands complete the sequence of operations for making one dot 120 of the "dot matrix" 116 for the specified character 114. A flexible fiberscope 146 with attached CCTV camera can be provided to view, the operation of the marking pin 30 for quality assurance verification of the desired stamping. Also, verification of linear movement for both the X and Y axes can be accomplished through feedback from optical encoders to the position verification card 60 located in the stepping motor control system 124.

The stepping motors 60,66 and drive system 124 are capable of 2500 steps per second with a total system accuracy of 0.0005 inch per inch of travel. After the commands for movement in the X and Y direction have been satisfied, the command for actuation of the solenoid valve of the air cylinder 42 is initiated. This command is processed through the stopping motor system controller card 134 and the input/output control card 130 also located in the system control cabinet 132. The system controller card 134 contains an on-board EEPROM memory capability of 4 k×8 bit. The starting, stopping, acceleration and deceleration of the stepping motors 60,66 along with the engage/disengage of the air cylinder solenoid valve and position verification/error flagging capability is down-loaded to the system controller card 134 memory and activated from that level. The system controller card 134 also has the capability of manual positioning of the stepping motors through the use of a manual joy stick option.

After the stamping device 128 has completed the marking of the identifying character code 112 for four adjacent tubes at a given base location, the expandable locking fingers 92 are disengaged and the entire device 28 is repositioned for the next set of four tubes to be marked. This process continues from the first row of tubes next to the divider plate 20 and continues across the tube sheet 14. This sequence remains the same until approximately the last eight rows of tubes are engaged in which case the entire stamping device 128 is positioned 180 degrees in relation to its normal stamping configuration.

All the components of the stamping device 128 are commercially available or readily fabricated. The software required for sequencing the X, Y and impact movements can be programmed in a straightforward manner by those skilled in the field of remote manipulation of steam generating service devices. Moreover, the program logic is analogous to, but simpler than that associated with conventional dot matrix printers for use in offices.

I claim:

1. Apparatus for remotely engraving a character on a metal surface of a tube sheet in the lower head of a nuclear steam generator, comprising:

(a) a base assembly including a first shaft;

(b) a carriage assembly connected to the first shaft for horizontal movement in a first direction relative to the base assembly, said carriage assembly including, (i) first drive means including a stepping motor associated with the first shaft, for imparting step wise linear movement to the carriage assembly relative to the first shaft, (ii) a second shaft oriented in a second direction perpendicularly to the first shaft, and (iii) second drive means including a stepping motor;

(c) a marker assembly mounted on the carriage assembly and moveable thereon in said second direction, said darker assembly including, (i) a marking pin adapted for vertical actuation, (ii) guide means for supporting the marking pin, said guide means connected to the second shaft for relative horizontal movement thereon, (iii) actuation means for selectively vertically actuating the marking pin into contact with the metal surface of the tube sheet, and (iv) means associated with the second drive means for imparting stepwise linear movement to the marker assembly relative to said second shaft;

(d) means connected to the base assembly and supported within said head, for positioning the base assembly immediately below a pre-selected portion of the tube sheet;

(e) a locking pin assembly mounted on the base assembly for selectively engaging at least one tube in the tube sheet to stabilize the base assembly during the operation of the actuation means; and (f) a control system for sequentially activating the first drive means, the second drive means, and the actuation means, whereby the marking pin engraves a dot matrix character on the metal surface of the tube sheet.

2. The apparatus recited in claim 1, wherein the first shaft includes a first rack and the first stepping motor is oriented vertically downward and includes a first spur gear engaging the first rack, for effecting the linear movement of the carriage assembly relative to the first shaft.

3. The apparatus recited in claim 2, wherein the second stepping motor includes a second spur gear and is vertically upwardly oriented on said carriage assembly adjacent the first stepping motor, and wherein the means associated with second drive means includes second rack engaging the second spur gear.

4. The apparatus recited in claim 3, wherein the first and second shafts are precision ground to smoothness, and wherein the connection of the carriage assembly to the first shaft and the connection of the marker assembly to the second shaft, are effected by ball bushing assemblies.

5. The apparatus recited in claim 4, wherein the marking pin is mounted in the guide means by a ball bushing.

6. The apparatus recited in claim 5, wherein the marker assembly further includes means adjacent the marking pin for remotely viewing the interaction of the marking pin and the tube sheet.

7. The apparatus recited in claim 3, wherein the carriage assembly further includes a generally U-shaped frame having a horizontal bottom plate adjacent the first shaft and two opposed, vertically extending side plates, the first and second stepping motors being mounted on the bottom plate and the second shaft being fixed to and spanning the side plates.

8. The apparatus recited in claim 4, wherein the ball bushings engaging the first shaft, are mounted in a bracket which extends rigidly downward from the bottom plate.

9. Apparatus for stamping a tube sheet, comprising:

(a) a base assembly including a first shaft;

(b) a carriage assembly connected to the first shaft for horizontal movement in a first direction relative to the base assembly, wherein the carriage assembly includes a generally u-shaped frame having a horizontal bottom plate adjacent the first shaft and two opposed, vertically extending side plates, said carriage assembly further including, (i) first drive means including a stepping motor associated with the first shaft, for imparting step wise linear movement to the carriage assembly relative to the first shaft, (ii) a second shaft oriented in a second direction perpendicularly to the first shaft, and (iii) second drive means including a stepping motor, the first and second stepping motors being mounted on the bottom plate and the second shaft being fixed to and spanning the side plates;

(c) a marker assembly mounted on the carriage assembly and moveable thereon in said second direction, said marker assembly including, (i) a marking pin adapted for vertical actuation, (ii) guide means for supporting the marking pin, said guide means connected to the second shaft for relative horizontal movement thereon, (iii) actuation means for selectively vertically actuating the marking pin into contact with the tube sheet, and (iv) means associated with the second drive means for imparting stepwise linear movement to the marker assembly relative to said second shaft; and (d) a control system for sequentially activating the first drive means, the second drive means, and the actuation means, whereby the marking pin engraves a dot matrix character on the tube sheet.

10. The apparatus recited in claim 9, wherein the first shaft includes a first rack and the first stepping motor is oriented vertically downward and includes a first spur gear engaging the first rack for effecting the linear movement of the carriage assembly relative to the first shaft.

11. The apparatus recited in claim 9, wherein the second stepping motor is vertically upwardly oriented on said carriage assembly adjacent the first stepping motor.

12. Apparatus for stamping a tube sheet, comprising:

(a) a base assembly including a first shaft;

(b) a carriage assembly connected to the first shaft for horizontal movement in a first direction relative to the base assembly, said carriage assembly including, (i) first drive means including a stepping motor associated with the first shaft, for imparting step wise linear movement to the carriage assembly relative to the first shaft, (ii) a second shaft oriented in a second direction perpendicularly to the first shaft, and (iii) second drive means including a stepping motor;

(c) a marker assembly mounted on the carriage assembly and moveable thereon in said second direction, said marker assembly including, (i) a marking pin adapted for vertical actuation, (ii) guide means for supporting the marking pin, said guide means connected to the second shaft for relative horizontal movement thereon, (iii) actuation means for selectively vertically actuating the marking pin into contact with the tube sheet, and (iv) means associated with the second drive means for imparting stepwise linear movement to the marker assembly relative to said second shaft;

(d) a control system for sequentially activating the first drive means, the second drive means, and the actuation means, whereby the marking pin engraves a dot matrix character on the tube sheet; and (e) means for supporting the base in a stationary position relative to the tube sheet, including a locking pin assembly mounted on the base of the assembly for selectively engaging as least one tube in the tube sheet, wherein the locking pin assembly includes a central rod, at least one tapered ferrule coaxially disposed around the rod, at least one tapered split ring abutting the ferrule, means associated with the rod for trapping the ferrule and ring within the tube, and means for displacing the rod vertically to selectively expand or contract the split ring by forcing the ferrule taper to move coaxially in relative contact with the ring taper.

13. The apparatus of claim 12, wherein each split ring has an internal taper on each axial end and wherein each ferrule has an external taper on at least one axial end.

* * * * *

REEXAMINATION CERTIFICATE (1532nd)

United States Patent [19] [11] B1 4,780,009

Crick [45] Certificate Issued Aug. 13, 1991

[54] STEAM GENERATOR TUBE SHEET AUTOMATIC STAMPING DEVICE

[75] Inventor: David L. Crick, Chattanooga, Tenn.

[73] Assignee: Combustion Engineering, Inc.

Reexamination Request:
No. 90/002,094, Jul. 25, 1990

Reexamination Certificate for:

| | |
|---|---|
| Patent No.: | **4,780,009** |
| Issued: | **Oct. 25, 1988** |
| Appl. No.: | **42,732** |
| Filed: | **Apr. 27, 1987** |

[51] Int. Cl.[5] ..... B41J 2/00; B41F 17/00

[52] U.S. Cl. ..... 400/118; 400/127; 101/4

[58] Field of Search ..... 400/118, 121, 127, 128, 400/129, 130, 131, 134; 101/3.1, 4, 18, 35

[56] References Cited

U.S. PATENT DOCUMENTS

| | | | |
|---|---|---|---|
| 3,606,162 | 9/1971 | Lehmann | 101/35 X |
| 3,867,882 | 2/1975 | Ahlgren et al. | 101/35 |
| 3,960,072 | 6/1976 | Ahlgren et al. | 101/35 |
| 4,089,262 | 5/1978 | Sopora | 101/4 |
| 4,304,800 | 12/1981 | French | 427/282 |
| 4,410,287 | 10/1983 | Speicher | 400/134 |
| 4,557,191 | 12/1985 | Speicher | 101/4 |
| 4,591,279 | 5/1986 | Speicher | 400/121 |
| 4,665,600 | 5/1987 | Faurie et al. | 101/35 X |

FOREIGN PATENT DOCUMENTS

| | | | |
|---|---|---|---|
| 2460134 | 7/1975 | Fed. Rep. of Germany | 101/4 |

OTHER PUBLICATIONS

Sales Brochure for Dot-A-Mark, Model 3200 (undated, one page).

Sales Brochure for Dot-A-Mark, Model 2000 (undated, one page).

*Primary Examiner*—Clifford D. Crowder

[57] ABSTRACT

A stamping device (28) having a stationary base assembly (76), a carriage assembly (52) mounted on the base assembly for stepwise horizontal movement in a first direction relative to the base assembly, and a marker assembly (34) mounted on the carriage assembly for stepwise horizontal movement in a second, perpendicular direction. The marker assembly includes a marking pin (30) vertically actuable by an air cylinder (42) for impacting the tube sheet (14) adjacent a preselected tube (16). A control system (124) sequentially activates stepping motors (60,66) and the air cylinder to produce a dot matrix character (114) on the tube sheet.

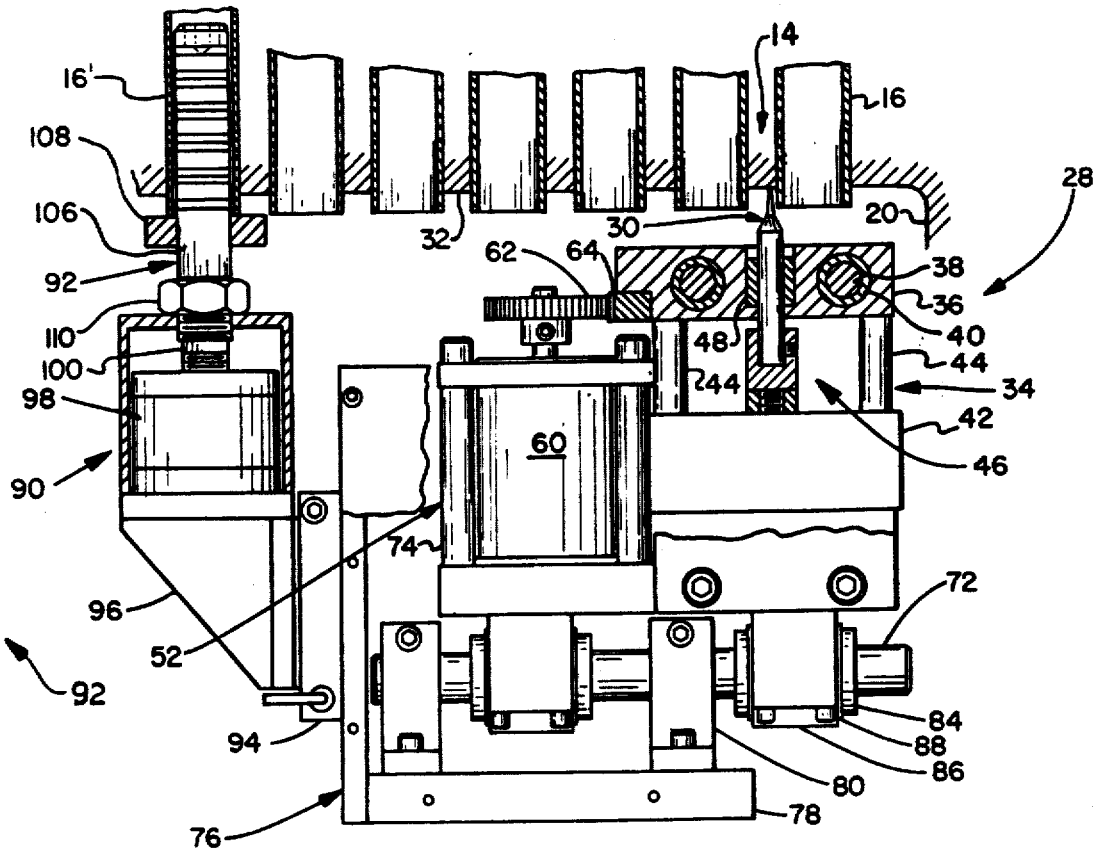

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–13 is confirmed.

Claims 2 and 3 are cancelled.

Claims 1, 4 and 7 are determined to be patentable as amended.

Claims 5, 6 and 8, dependent on an amended claim, are determined to be patentable.

1. Apparatus for remotely engraving a character on a metal surface of a tube sheet in the lower head of a nuclear steam generator, comprising:

(a) a base assembly including a first shaft *which has a first rack;*

(b) a carriage assembly connected to the first shaft for horizontal movement in a first direction relative to the base assembly, said carriage assembly including, (i) first drive means including a *first* stepping motor associated with the first shaft, for imparting step wise linear movement to the carriage assembly relative to the first shaft, *wherein the first stepping motor is oriented vertically downward and includes a first spur gear engaging the first rack, for effecting the linear movement of the carriage assembly relative to the first shaft;*

(ii) a second shaft oriented in a second direction perpendicularly to the first shaft, and (iii) second drive means including a *second* stepping motor *which has a second spur gear and is vertically upwardly oriented on said carriage assembly adjacent the first stepping motor;*

(c) a marker assembly mounted on the carriage assembly and moveable thereon in said direction, said [darker] *marker* assembly including, (i) a marking pin adapted for vertical actuation, (ii) guide means for supporting the marking pin, said guide means connected to the second shaft for relative horizontal movement thereon, (iii) actuation means for selectively vertically actuating the marking pin into contact with the metal surface of the tube sheet, and (iv) means associated with the second drive means *and including a second rack engaging the second spur gear,* for imparting stepwise linear movement to the marker assembly relative to said second shaft;

(d) means connected to the base assembly and supported within said head, for positioning the base assembly immediately below a pre-selected portion of the tube sheet;

(e) a locking pin assembly mounted on the base assembly for *entering into and* selectively [engaging] *locking against* at least one tube in the tube sheet to [stabilize] *resist vertical movement of* the base assembly during the operation of the actuation means; and (f) a control system for sequentially activating the first drive means, the second drive means, and the actuation means, whereby the marking pin engraves a dot matrix character on the metal surface of the tube sheet.

4. The apparatus recited in claim [3] *1*, wherein the first and second shafts are precision ground to smoothness, and wherein the connection of the carriage assembly to the first shaft and the connection of the marker assembly to the second shaft, are effected by ball bushing assemblies.

7. The apparatus recited in claim [3] *1*, wherein the carriage assembly further includes a generally U-shaped frame having a horizontal bottom plate adjacent the first shaft and two opposed, vertically extending side plates, the first and second stepping motors being mounted on the bottom plate and the second shaft being fixed to and spanning the side plates.

* * * * *